US010875141B1

(12) United States Patent
Weisbarth et al.

(10) Patent No.: US 10,875,141 B1
(45) Date of Patent: Dec. 29, 2020

(54) PAINT TRENCHER

(71) Applicants: Lynette Weisbarth, Bremerton, WA (US); Randal Weisbarth, Bremerton, WA (US)

(72) Inventors: Lynette Weisbarth, Bremerton, WA (US); Randal Weisbarth, Bremerton, WA (US)

( * ) Notice: Subject to any disclaimer, the term of this patent is extended or adjusted under 35 U.S.C. 154(b) by 0 days.

(21) Appl. No.: 16/733,078

(22) Filed: Jan. 2, 2020

(51) Int. Cl.

| | |
|---|---|
| ***B24B 23/00*** | (2006.01) |
| ***B24B 7/18*** | (2006.01) |
| ***B24D 15/02*** | (2006.01) |
| ***B24D 15/04*** | (2006.01) |
| ***B05D 3/12*** | (2006.01) |

(52) U.S. Cl.
CPC ..... *B24B 23/00* (2013.01); *B05D 3/12* (2013.01); *B24B 7/18* (2013.01); *B24B 7/182* (2013.01); *B24D 15/02* (2013.01); *B24D 15/04* (2013.01)

(58) Field of Classification Search
CPC ..... B24B 7/18; B24B 7/182; B24B 23/00; B24D 15/02; B24D 15/023; B24D 15/04
USPC ..... 451/344, 354, 494, 523, 524, 525, 552, 451/557, 558
See application file for complete search history.

(56) References Cited

U.S. PATENT DOCUMENTS

| | | | | |
|---|---|---|---|---|
| 2,569,253 | A * | 9/1951 | Opland | B24D 15/023 451/523 |
| 5,885,145 | A * | 3/1999 | O'Mara | A46B 13/008 15/22.2 |
| 7,264,541 | B1 * | 9/2007 | Ray | B24D 15/023 451/344 |
| 7,485,031 | B1 * | 2/2009 | Stubbs | B24B 7/184 451/523 |
| 9,511,480 | B1 * | 12/2016 | Ingram, Sr. | B24D 15/04 |
| 2017/0297051 | A1 * | 10/2017 | Cameron | B05C 17/0245 |
| 2020/0094378 | A1 * | 3/2020 | Sigler | B24D 15/023 |

OTHER PUBLICATIONS

"Triangle Arkansas File", sharpeningsupplies.com, https://www.sharpeningsupplies.com/Triangle-Arkansas-File-P376.aspx.

* cited by examiner

*Primary Examiner* — Eileen P Morgan

(57) ABSTRACT

A paint trencher includes a main body, a guide, an abrasive body, a first adjustable bracket, a second adjustable bracket, and a handle. The main body includes a top panel, a support, a first pin, and a second pin. The guide is rotatably connected to the first pin and the second pin so that paint trencher can be adjusted according to the ceiling corners or vertical corners. The abrasive body is adjacently mounted to the support, and the handle is mounted to the top panel so that applied pressure of the main body can be transferred into the abrasive body to cut a trench into the wall. The first adjustable bracket and the second adjustable bracket are oppositely positioned of each other about the support and are operatively coupled between the top panel and the guide thus enabling the guide to be adjusted and locked about the main body.

7 Claims, 9 Drawing Sheets

PAINT TRENCHER

FIELD OF THE INVENTION

The present invention relates generally to paint surface preparation tools. More specifically, the present invention is an apparatus that prepares a wall for crisp, clean paint lines by sanding off obstacles such as texture and paint build-up while at the same time creating a trench that acts as a guide for the tip of a paintbrush and a well for paint to flow into.

BACKGROUND OF THE INVENTION

When it comes to painting walls, one of the hardest and most time-consuming parts is painting around the vertical wall corners and ceiling corners. In order to get razor-sharp edge lines, painters normally use paint edger tools or painter's tape. Paint edger tools are typically used for wall painting above baseboards, below crown molding, around window and door trim, and at the juncture between two walls, such as for accent walls. Sometimes paint edger tools can cause problems for painters due to handling difficulties and inexperience. Additionally, if there is any texture on the wall, paint edger tools do not work to their full capacity. Paint edger tools work best on smooth surfaces. Painter's tape, also known as masking tape, is a type of pressure-sensitive tape made of a thin and easy-to-tear paper, and an easily released pressure-sensitive adhesive. The adhesive is the key element to its usefulness, as it allows the painter's tape to be easily removed without leaving residue or damaging the surface to which it is applied. However, applying painter's tape can be time consuming and expensive. More importantly, painter's tape does not work effectively on textured walls because the texture creates gaps, compromising the seal of the tape to the wall, which causes the paint to "bleed" through and give a sloppy appearance.

It is therefore an objective of the present invention to provide an apparatus that sands off a ⅛" line of the existing texture on the portion of the wall closest to the ceiling so as to provide a smooth surface for the bristles of a paint brush to run across without any obstruction. In addition to sanding off the texture, the abrasive body has a slight angle or protrusion on the distal edge which is, as pressure is being applied to do the sanding, cause a "trench" that the paint flows into when running the brush along the cutting line. Also, by sanding the texture off of inside corners, paint edging tools can be used to their fullest capacity. Additionally, the present invention provides an adjustable guide that helps brace the tool and hold it in a sturdy position while sanding, further ensuring a stable, straight line. The guide is adjustable in order to meet the needs of any angled wall or ceiling. As a result of the trench, the painters can get sharp paint lines without any guesswork.

DETAIL DESCRIPTIONS OF THE INVENTION

All illustrations of the drawings are for the purpose of describing selected versions of the present invention and are not intended to limit the scope of the present invention.

The present invention is a paint trencher that cuts a clean trench into ceiling corners or vertical corners such as above baseboard, below crown molding, around window and door trim, and at the juncture between two walls or wall and ceiling. Once the present invention is utilized to cut the trench, a paint brush can be followed along the trench in order to get clean and crisp paint lines as the tip of the paint brush can be placed within the trench.

Figure 1:
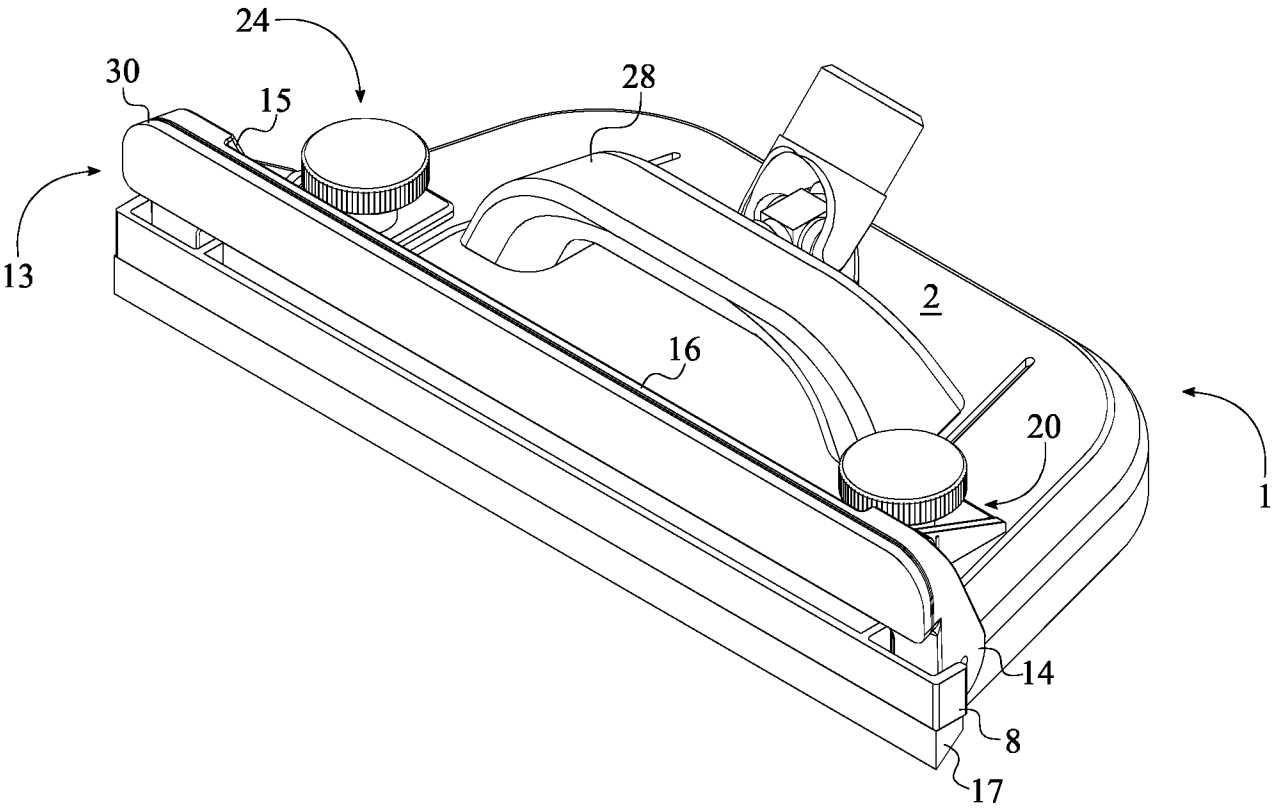
FIG. 1 is a front top perspective view of the present invention.
Figure 2:
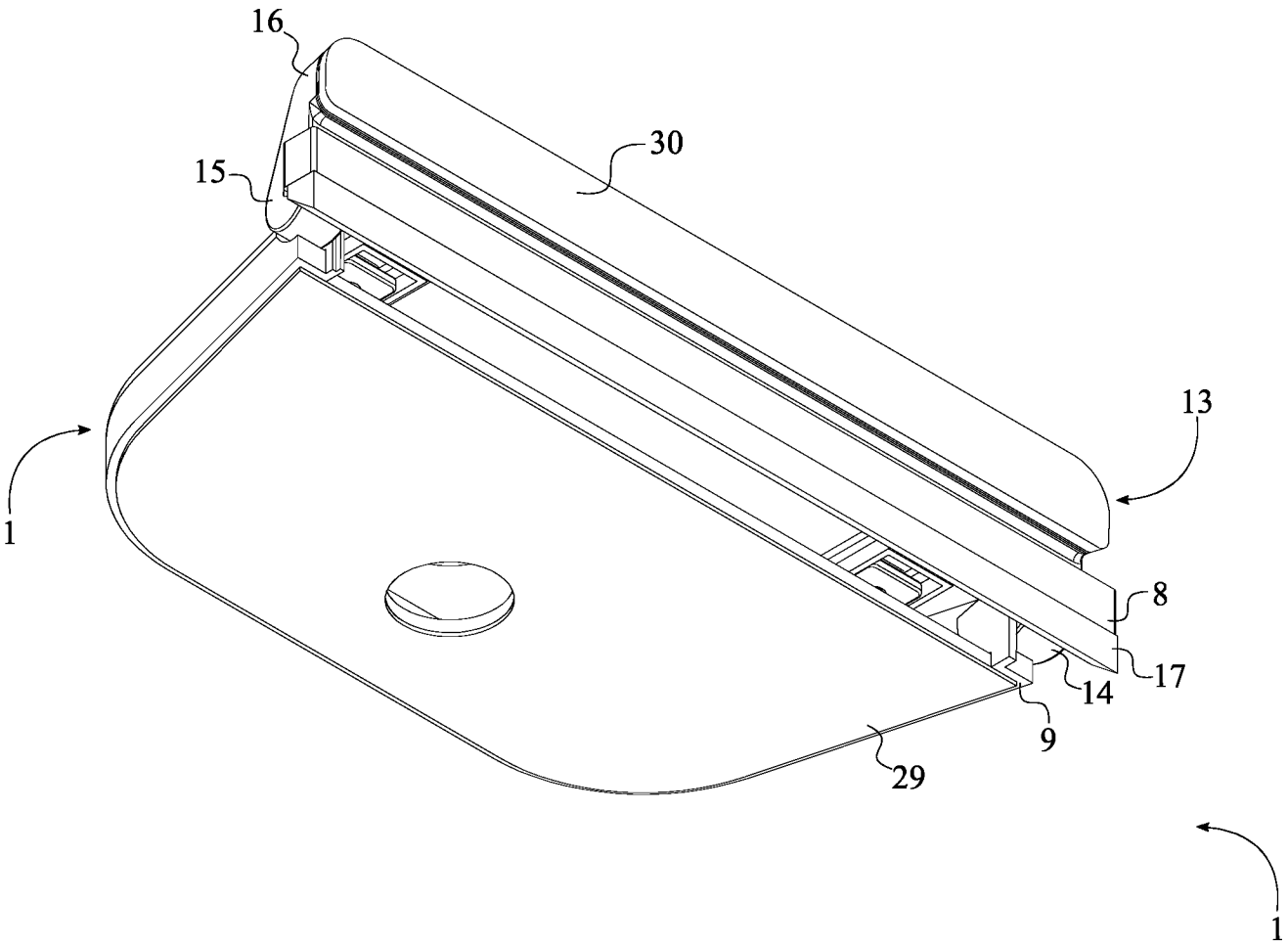
FIG. 2 is a front bottom perspective view of the present invention.
Figure 3:
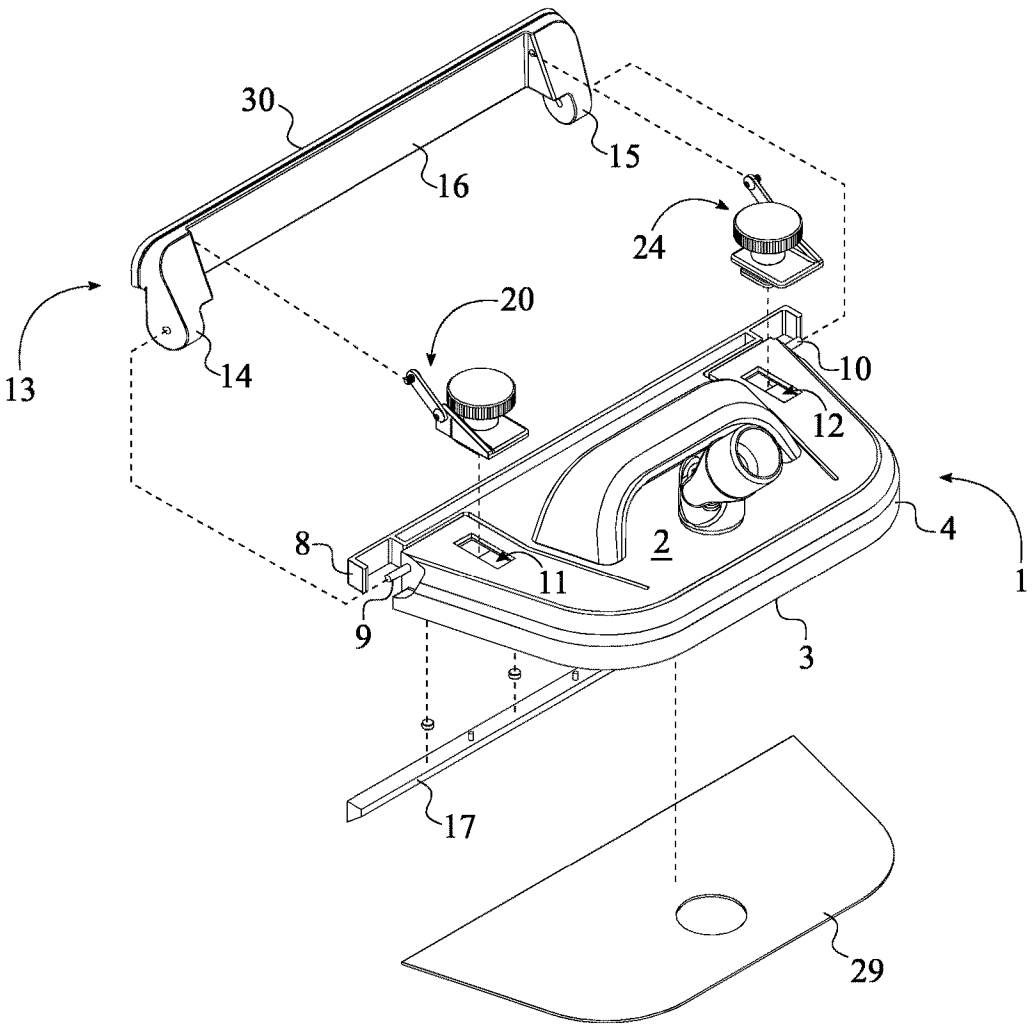
FIG. 3 is a rear perspective exploded view of the present invention.

The present invention comprises a main body 1, a guide 13, an abrasive body 17, a first adjustable bracket 20, a second adjustable bracket 24, and a handle 28 as shown in FIG. 1-3. The main body 1 comprises a top panel 2, a support 8, a first pin 9, and a second pin 10 thus enabling the rest of the components to be referenced and connected. In reference to the general configuration, the guide 13 is rotatably connected to the first pin 9 and the second pin 10 so that the guide 13 can be angularly rotated about the main body 1 to accommodate a specific angles between two different wall surfaces. The first adjustable bracket 20 and the second adjustable bracket 24 are oppositely positioned of each other about the support 8 and operatively coupled between the top panel 2 and the guide 13. As a result, a user can lock the exact angular positioning of the guide 13 when the main body 1 and the guide 13 are rested upon two different wall surfaces. The abrasive body 17 is adjacently mounted to the support 8 and functions as the cutting apparatus so that existing wall textures can be sand off and the trench can be cut into the wall. The handle 28 that provides surface area to grip and control the main body 1 is mounted to the top panel 2 and positioned opposite of the abrasive body 17. Due to the opposite positioning of the handle 28 and the abrasive body 17, when a user applies pressure to the present invention, the handle 28 can transfer the applied pressure into the abrasive body 17 via the main body 1 thus sanding existing wall textures and cutting the trench into the wall.

The main body 1 functions as a base structure within the present invention as the rest of components are functionally positioned around the main body 1. Additionally, the main body 1 also rests upon a first wall surface so that the guide 13 can be rested upon a second wall surface to operate the present invention. In reference to FIG. 5-6, the main body 1 further comprises a bottom panel 3 and a lateral wall 4. More specifically, the top panel 2 and the bottom panel 3 are oppositely connected to the lateral wall 4 so that the general shape of the main body 1 can be delineated. The support 8 is an elongated structure and laterally connected along a front section 5 of the lateral wall 4 thus providing the necessary surface area to mount the abrasive body 17. The first pin 9 and the second pin 10 are cylindrical bodies that are oriented outward from the main body 1. In other words, the first pin 9 is laterally connected about a left section 6 of the lateral wall 4. The second pin 10 is laterally connected about a right section 7 of the lateral wall 4. The first pin 9 and the second pin 10 are also concentrically positioned with each other so that the guide 13 can be rotatably connected. Furthermore, the first pin 9 and the second pin 10 are positioned adjacent and behind the support 8 in order to provide sufficient spacing for the rotation of the guide 13.

Figure 5:
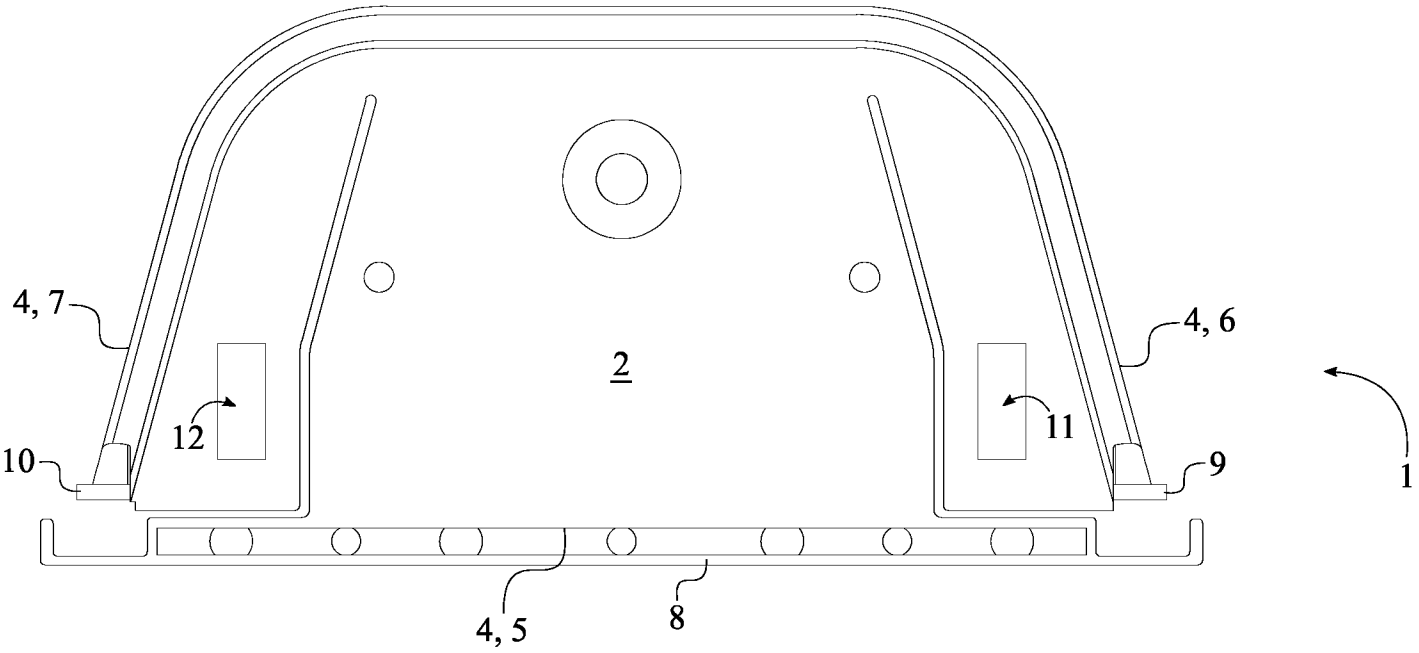
FIG. 5 is a top view for the main body of the present invention.
Figure 6:
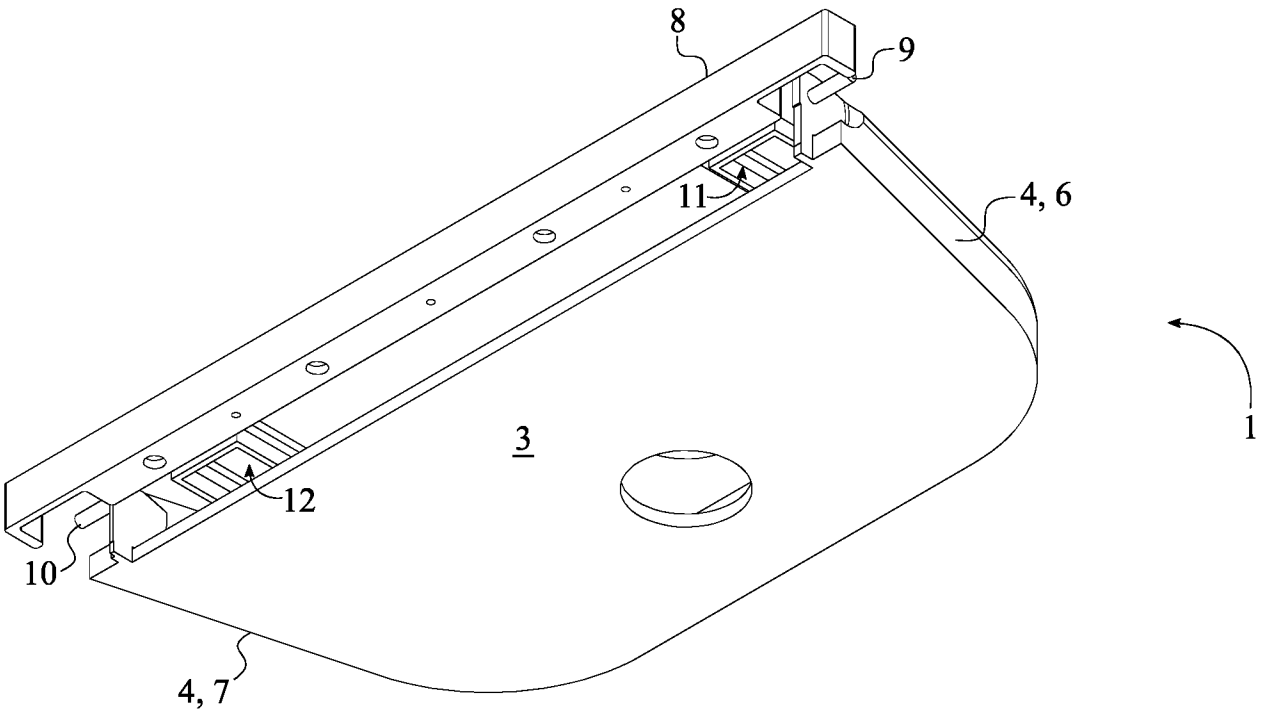
FIG. 6 is a bottom perspective view for the main body of the present invention.

In reference to FIG. 3 and FIG. 5, the main body 1 further comprises a first track 11 and a second track 12 so that the first adjustable bracket 20 and the second adjustable bracket 24 can be operatively coupled to the top panel 2. The first track 11 and the second track 12 are shaped into rectangular profiles and oriented perpendicular to the front section 5 of the lateral wall 4. More specifically, the first track 11 and the second track 12 traverse through the top panel 2 so that the first adjustable bracket 20 and the second adjustable bracket 24 can be slidably engaged within. In order to provide precise angular accuracy for the guide 13, the first track 11 is oriented perpendicular to the first pin 9 and positioned adjacent to the first pin 9. The second track 12 is oriented perpendicular to the second pin 10 and positioned adjacent to the second pin 10. As a result of the opposite positioning of the first adjustable bracket 20 and the second adjustable bracket 24 about the support 8, the guide 13 is able to maintain similar angles with respect to each end of the guide 13 so that the guide 13 can be completely flushed against the second wall surface.

Figure 7:
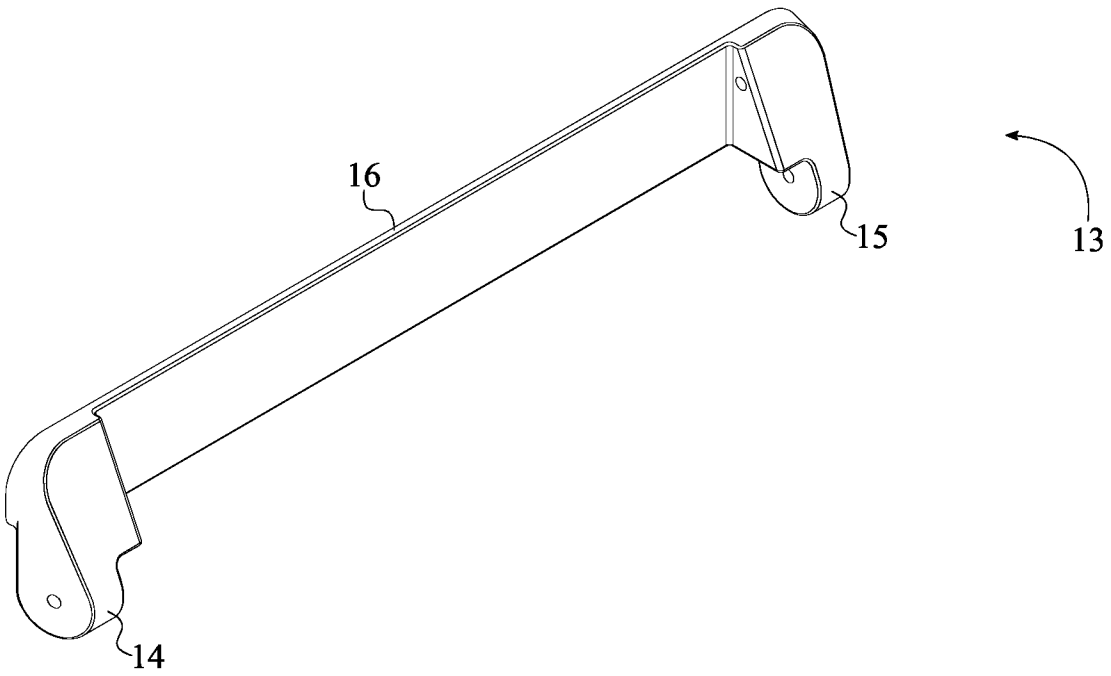
FIG. 7 is a rear perspective view of the guide of the present invention.

The guide 13 is configured to angular position along the second wall surface. In reference to FIG. 3 and FIG. 7, the guide 13 comprises a first arm 14, a second arm 15, and a cross plate 16. The first arm 14 and the second arm 15 function as the supporting arms of the guide 13 so that the guide 13 can be operated. More specifically, the first arm 14 is terminally connected to the cross plate 16. The second arm 15 is terminally connected to the cross plate 16 and positioned opposite of the first arm 14. In other words, the first arm 14 and the second arm 15 are terminally connected onto a rear surface of the cross plate 16 while free ends of the first arm 14 and the second arm 15 are positioned adjacent to the first pin 9 and the second pin 10. The first arm 14 is rotatably connected around the first pin 9 thus rotatably connecting the guide 13 to the main body 1 from one end. The second arm 15 is rotatably connected around the second pin 10 thus rotatably connecting the guide 13 to the main body 1 from the opposite end. Resultantly, the first arm 14 and the second arm 15 are able to maintain a constant clearance between the main body 1 and the cross plate 16 during the rotation of the guide 13.

In reference to FIG. 3, the present invention further comprises a first felt pad 29. More specifically, the first felt pad 29 is perimetrically attached around the bottom panel 3 and oriented opposite of the top panel 2. The first felt pad 29 provides a smooth surface area for the main body 1 so that the first wall surface does not get damage during the operation of the present invention.

In reference to FIG. 3, the present invention further comprises a second felt pad 30. More specifically, the second felt pad 30 is perimetrically attached around the cross plate 16 and oriented opposite of the first arm 14 and the second arm 15. The second felt pad 30 provides a smooth surface area for the guide 13 so that the second wall surface does not get damage during the operation of the present invention.

Figure 4:
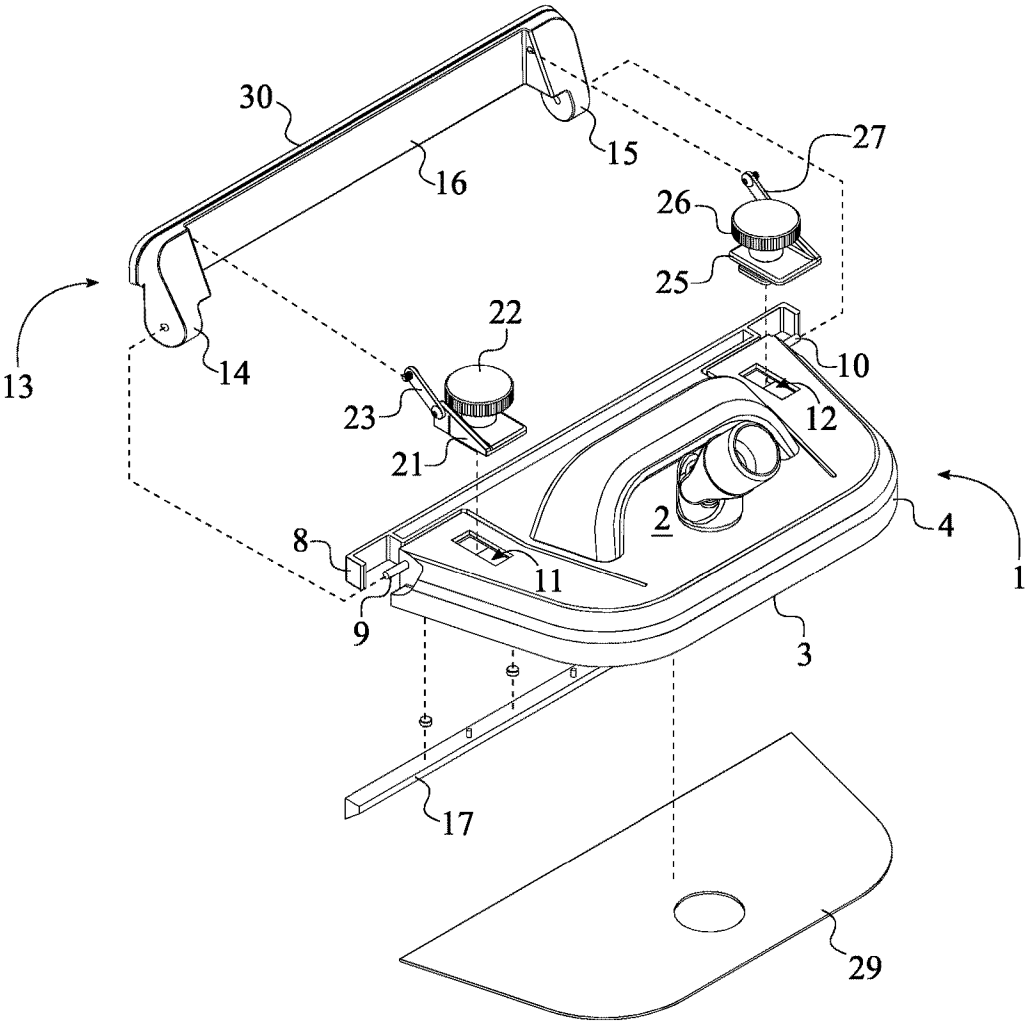
FIG. 4 is a rear perspective exploded view of the present invention, showing the components of the first adjustable bracket and the second adjustable bracket.

In reference to FIG. 3-4, the first adjustable bracket 20 comprises a first slidable bracket 21, a first tightening screw assembly 22, and a first link 23. The first tightening screw assembly 22 is integrated into the first slidable bracket 21 and slidably engaged within the first track 11 so that the first tightening screw assembly 22 and the first slidable bracket 21 can slide along the first track 11. The first link 23 is rotatably attached in between the first slidable bracket 21 and the first arm 14 so that the guide 13 can be rotated around the first pin 9 with the simultaneous movement of the first slidable bracket 21. More specifically, the first tightening screw assembly 22 comprises a thumb screw and a nut so that the nut can be engaged within the first track 11 while the thumb screw is threadedly engaged with the nut through the first slidable bracket 21. Since the first link 23 is a rigid body, forward and backward movements of the first tightening screw assembly 22 and the first slidable bracket 21 correspond to downward and upward angular movements of the guide 13. Once the desired angle of the guide 13 is attained with respect to the angle of the second wall surface, the thumb screw and the nut can be tightened about the first slidable bracket 21 and the first track 11 thus locking the guide 13 with respect to the first adjustable bracket 20.

In reference to FIG. 3-4, the second adjustable bracket 24 comprises a second slidable bracket 25, a second tightening screw assembly 26, and a second link 27. The second tightening screw assembly 26 is integrated into the second slidable bracket 25 and slidably engaged within the second track 12 so that the second tightening screw assembly 26 and the second slidable bracket 25 can slide along the second track 12. The second link 27 is rotatably attached in between the second slidable bracket 25 and the second arm 15 so that the guide 13 can be rotated around the second pin 10 with the simultaneous movement of the second slidable bracket 25. More specifically, the second tightening screw assembly 26 comprises a thumb screw and a nut so that the nut can be engaged within the second track 12 while the thumb screw is threadedly engaged with the nut through the second slidable bracket 25. Since the second link 27 is a rigid body, forward and backward movements of the second tightening screw assembly 26 and the second slidable bracket 25 correspond to downward and upward angular movements of the guide 13. Once the desired angle of the guide 13 is attained with respect to the angle of the second wall surface, the thumb screw and the nut can be tightened about the second slidable bracket 25 and the second track 12 thus locking the guide 13 with respect to the second adjustable bracket 24.

Figure 8:
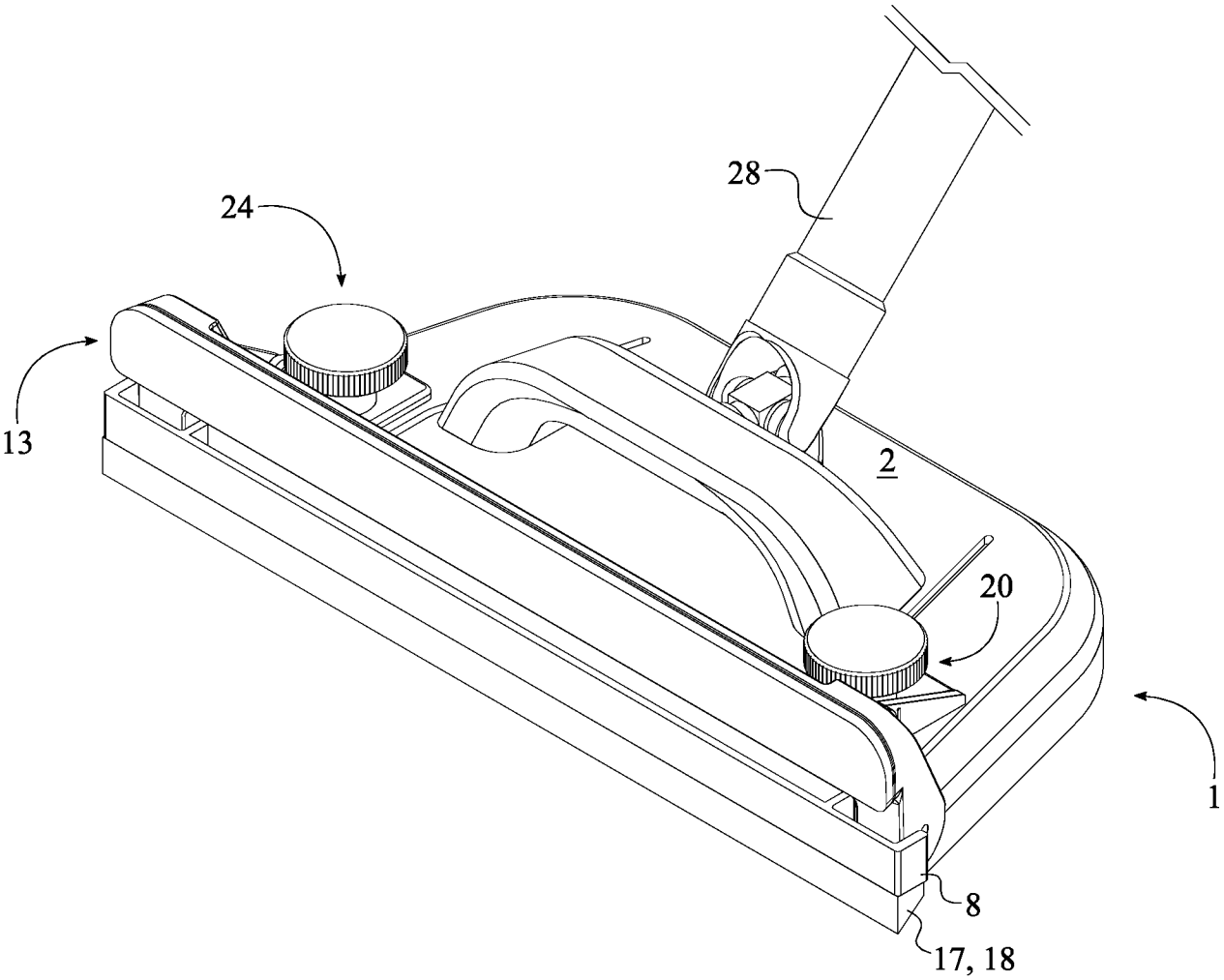
FIG. 8 is a front top perspective view of the present invention, showing the handle being pivotably mounted on the top panel and the abrasive body being the beveled-elongated body.

The handle 28 is configured into an ergonomic grip so that the handle 28 can be comfortable gripped to control the main body 1. In some embodiment of the present invention, the handle 28 is a U-shaped body and mounted onto the top panel 2 as shown in FIG. 1. Furthermore, the handle 28 and the top panel 2 provide a fixed connection in such a way that any directional movements of the handle 28 directly translates into the main body 1. In some embodiment of the present invention, the handle 28 is an elongated shaft/pole and pivotably mounted onto the top panel 2 through an industry standard pivoting mechanism as shown in FIG. 8. For example, the industry standard pivoting mechanism can include, but is not limited to, a swivel mount, a ball joint mount, or other similar pivoting mounts. Due to the pivotable connection, the handle 28 can be utilized to reach area such as high ceilings and narrow corners while maintaining the functionality of the abrasive body 17.

The abrasive body 17 is preferably a beveled-elongated body 18 as shown in FIG. 8. The beveled-elongated body 18 resembles a configuration of a chisel-end so that the abrasive body 17 is able to sand of existing wall textures such as paint, bumps, and textured design features, and cut into the first wall surface. The beveled-elongated body 18 can be incorporated with different grit size sanding materials such as adhesive sandpapers or manufactured as a semi-flexible sanding block with different grit sizes to accommodate different varieties of texture (light or heavy). More specifically, a distal edge of the beveled-elongated body 18 is oriented toward the bottom panel 3 and extended along the support 8. As a result, the distal edge of the beveled-elongated body 18 is able to face toward the first wall surface when the present invention is utilized. When the main body 1 is moved along the first wall surface, the distal edge of the beveled-elongated body 18 slides along and cuts into the first wall surface thus creating the trench. Simultaneously, a flat surface of the beveled-elongated body 18 that is positioned parallel to the support 8 is able to sand of existing wall textures of the second wall surface such as paint buildup and bumps. The flat surface of the beveled-elongated body 18 is able to complete the sanding process through an adhesive sanding paper that is attached to the flat surface of the beveled-elongated body 18 or the flat surface of the beveled-elongated body 18 itself functioning as a sanding block.

The beveled-elongated body 18 is removably mounted along the support 8 so that the user can easily replace any worn out beveled-elongated body with a newer beveled-elongated body. Preferably, a plurality of magnets is embedded within the support 8 so that the beveled-elongated body 18 can be magnetically attached to the support 8 through the plurality of magnets. Furthermore, a plurality of positioning bodies are connected along a base surface of the beveled-elongated body 18 so that the plurality of positioning bodies can be inserted into a corresponding opening of the support 8 to prevent any lateral movements thus firmly securing the beveled-elongated body 18 to the support 8.

Preferably, a width of the beveled-elongated body 18 is ⅛ inches and delineated along the flat surface of the beveled-elongated body 18. As a result, the present invention is able to sand off a small line of existing texture along the second wall surface. However, the width of the beveled-elongated body 18 is not limited to ⅛ inches and can be any other width larger than ⅛ inches to accommodate specific requirements of the paints.

In some embodiment of the present invention, a plurality of teeth can be integrated into the distal edge of the beveled-elongated body 18. As a result, the plurality of teeth is able to simplify the trench cutting process when utilized within the first wall surface.

Figure 9:
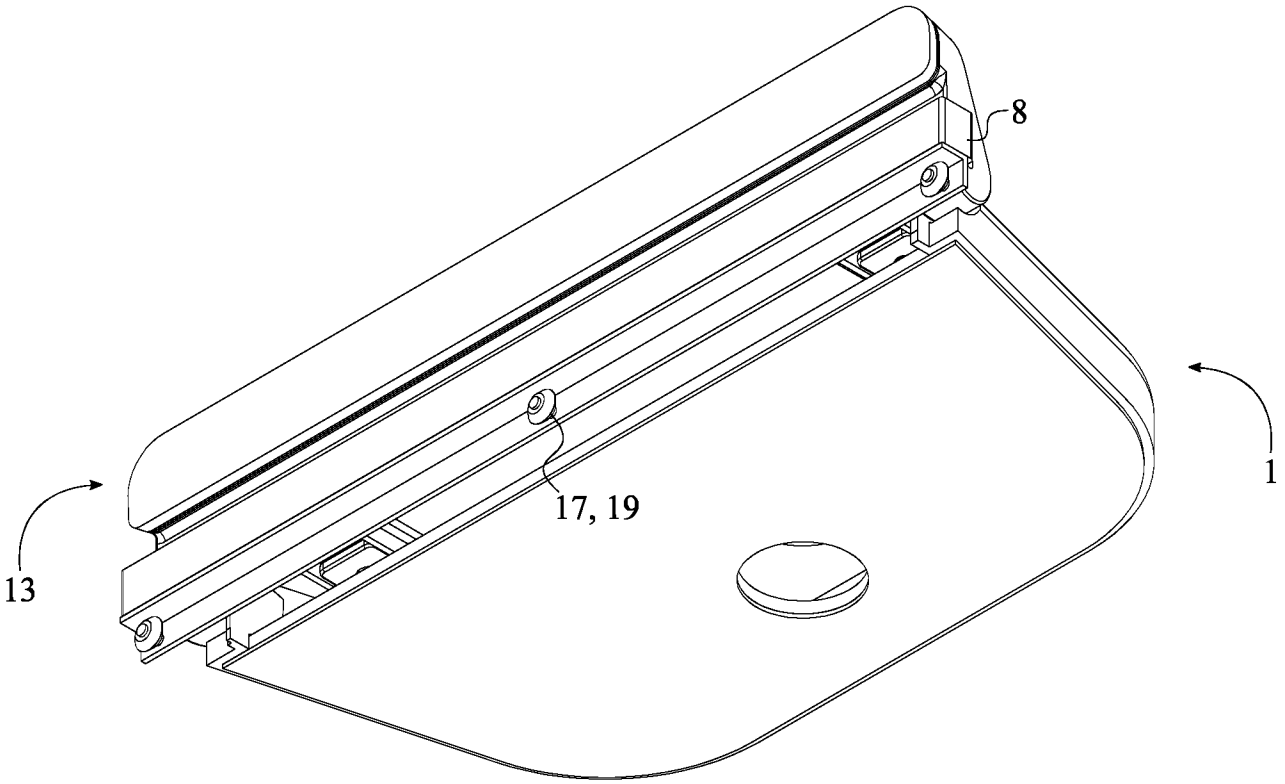
FIG. 9 is a front bottom perspective view of the present invention, showing the abrasive body being the at least one beveled-wheel assembly.

In some embodiment of the present invention, the abrasive body 17 can be at least one beveled-wheel assembly 19 as shown in FIG. 9. The beveled-wheel assembly 19 is oriented toward the bottom panel 3 and removably mounted along the support 8. More specifically, the beveled-wheel assembly 19 comprises a connector and a beveled wheel. The connector is removably mounted to the support 8 as the beveled wheel is rotatably connected to the support 8. As a result, when the main body 1 is moved along the first wall surface, the beveled wheel rotates along and cuts into the first wall surface thus creating the trench.

Although the invention has been explained in relation to its preferred embodiment, it is to be understood that many other possible modifications and variations can be made without departing from the spirit and scope of the invention as hereinafter claimed.

What is claimed is:

1. A trencher comprising:

a main body;

a guide;

an abrasive body;

a first adjustable bracket;

a second adjustable bracket;

a handle;

the main body comprising a first panel, a support, a first pin, and a second pin;

the guide being rotatably connected to the first pin and the second pin;

the abrasive body being mounted to the support;

the first adjustable bracket and the second adjustable bracket being separate from each other along the support;

the first adjustable bracket and the second adjustable bracket being positioned between the top-first panel and the guide;

the handle being mounted to the first panel;

the main body further comprising a second panel and a lateral wall;

the first panel and the second panel being oppositely connected to the lateral wall;

the support being laterally connected along an intermittent section of the lateral wall;

the first pin being laterally connected about a first side section of the lateral wall;

the second pin being laterally connected about a second side section of the lateral wall;

the intermittent section being positioned between the first side section and the second side section;

the first pin and the second pin being concentrically positioned with each other;

the main body further comprising a first track and a second track;

the first track being oriented perpendicular to the first pin;

the first track being positioned adjacent to the first pin;

the second track being oriented perpendicular to the second pin;

the second track being positioned adjacent to the second pin;

the first track and the second track traversing through the first panel;

the guide comprising a first arm, a second arm, and a cross plate;

the first arm being terminally connected to the cross plate;

the second arm being terminally connected to the cross plate, opposite of the first arm;

the first arm being rotatably connected around the first pin;

the second arm being rotatably connected around the second pin;

the guide being configured to be angularly rotated about the main body via the first arm, the first pin, the second arm and the second pin so as to accommodate a specific angle between two wall surfaces;

the first adjustable bracket comprising a first slidable bracket, a first tightening screw assembly, and a first link;

the first tightening screw assembly being integrated into the first slidable bracket;

the first tightening screw assembly being slidably engaged within the first track of the main body;

the first link being rotatably attached in between the first slidable bracket and the first arm of the guide;

the second adjustable bracket comprising a second slidable bracket, a second tightening screw assembly, and a second link;

the second tightening screw assembly being integrated into the second slidable bracket;

the second tightening screw assembly being slidably engaged within the second track of the main body;

the second link being rotatably attached in between the second slidable bracket and the second arm of the guide;

the abrasive body being configured to sand off existing wall textures and cutting a trench into a wall.

2. The trencher as claimed in claim 1 comprising:

a first felt pad;

the first felt pad being perimetrically attached to the second panel; and the first felt pad being oriented opposite of the first panel.

3. The trencher as claimed in claim 1 comprising:

a second felt pad;

the second felt pad being perimetrically attached to the cross plate; and the second felt pad being oriented opposite of the first arm and the second arm.

4. The trencher as claimed in claim 1, wherein the handle is mounted onto the first panel.

5. The trencher as claimed in claim 1, wherein the handle is pivotably mounted onto the first panel.

6. The trencher as claimed in claim 1 comprising:

the abrasive body being a beveled-elongated body;

the beveled-elongated body being extended along the support; and the beveled-elongated body being removably mounted along the support.

7. The trencher as claimed in claim 1 comprising:

the abrasive body being at least one beveled-wheel assembly; and the beveled-wheel assembly being removably mounted along the support.

* * * * *